US005887678A

United States Patent [19]

Lavender

[11] Patent Number: 5,887,678

[45] Date of Patent: Mar. 30, 1999

[54] LUBRICATION APPARATUS FOR SHAFT BEARING

[75] Inventor: Stephen J. Lavender, Racine, Wis.

[73] Assignee: Briggs & Stratton Corporation, Wauwatosa, Wis.

[21] Appl. No.: 878,665

[22] Filed: Jun. 19, 1997

[51] Int. Cl.[6] ..... F01M 1/00

[52] U.S. Cl. ..... 184/11.2; 184/6.5; 184/6.18; 123/196 R

[58] Field of Search ..... 184/11.1, 11.2, 184/6.12, 6.5, 13.1, 26, 6.18; 123/196 R

[56] References Cited

U.S. PATENT DOCUMENTS

| | | | |
|---|---|---|---|
| 1,014,628 | 1/1912 | Lieber . | |
| 1,271,140 | 7/1918 | Dickey . | |
| 1,402,281 | 1/1922 | Brockway . | |
| 1,426,869 | 8/1922 | Hazard | 184/11.1 |
| 1,842,303 | 1/1932 | Wainwright . | |
| 1,842,530 | 1/1932 | Mack | 184/6.12 |
| 2,023,535 | 12/1935 | Mayo et al. | 184/11.1 |
| 2,034,198 | 3/1936 | Nelson | 184/6.12 |
| 2,343,211 | 2/1944 | Warneke et al. | 184/11.1 |
| 2,427,638 | 9/1947 | Vilter et al. | 184/6.12 |
| 3,144,097 | 8/1964 | Ebert | 184/6.18 |
| 4,221,279 | 9/1980 | Jones et al. . | |
| 4,359,142 | 11/1982 | Schultz et al. . | |
| 4,926,814 | 5/1990 | Bonde | 184/6.18 |
| 5,143,033 | 9/1992 | Catterson et al. . | |

OTHER PUBLICATIONS

Photo Depicting an Upper Portion of a Crankcase for a Vertical Shaft Engine First Sold by Briggs & Stratton at Least as Early as 1960.

*Primary Examiner*—Thomas E. Denion
*Attorney, Agent, or Firm*—Michael Best & Friedrich LLP

[57] ABSTRACT

Disclosed herein is a lubrication system for an internal combustion engine including a lubricant reservoir, a lubricant dispersing device disposed in communication with the lubricant reservoir, and a lubrication apparatus including a recess integrally formed with an engine housing and an elongated trough disposed substantially within the recess and in fluid communication with a shaft bearing. The recess has an opening that extends radially outward relative to the shaft axis such that the lubricant dispersing device can disperse lubricant, during at least a portion of the engine cycle, along a direct and substantially unobstructed path into the recess. The trough is adapted to direct the lubricant received in the recess to the shaft bearing. The trough also extends radially outward and is inclined downwardly in a direction toward the shaft bearing. The recess further includes a back surface and a sidewall disposed substantially adjacent to the shaft bearing, which define a substantially unobstructed space between the recess opening and the back surface.

29 Claims, 4 Drawing Sheets

FIG. 2
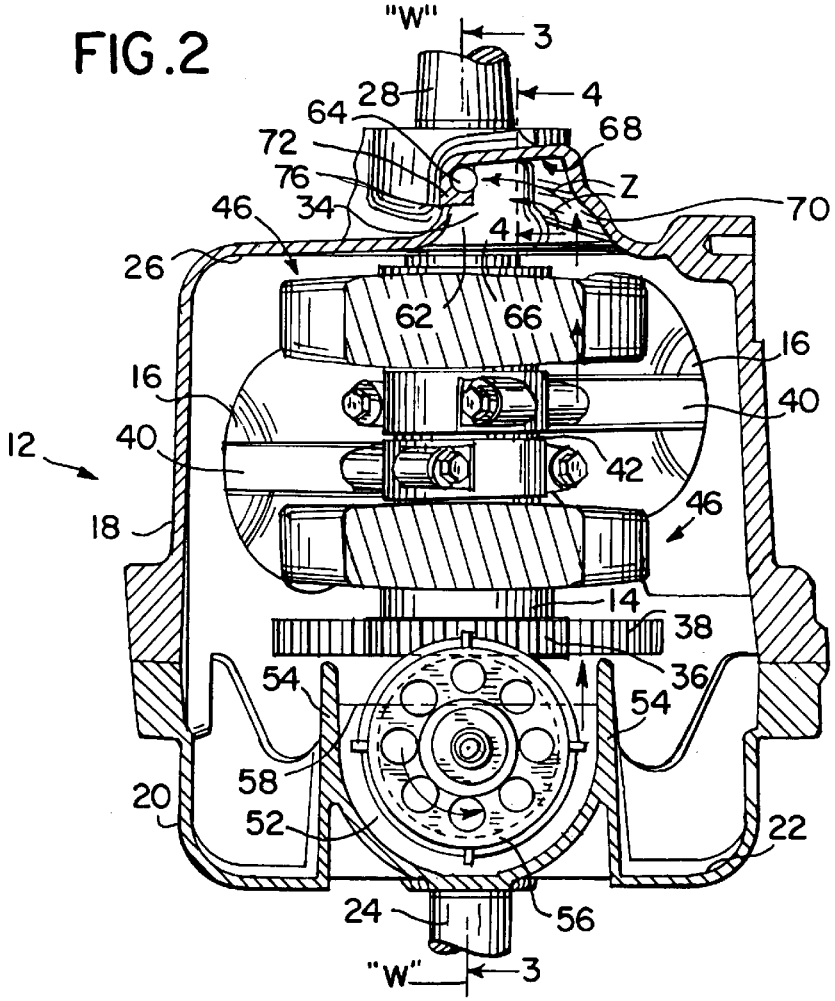
FIG. 4
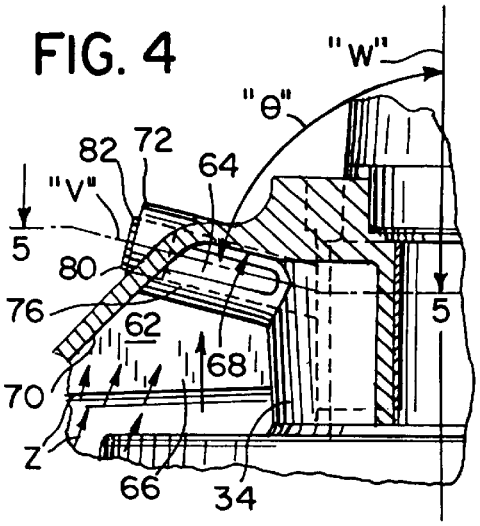
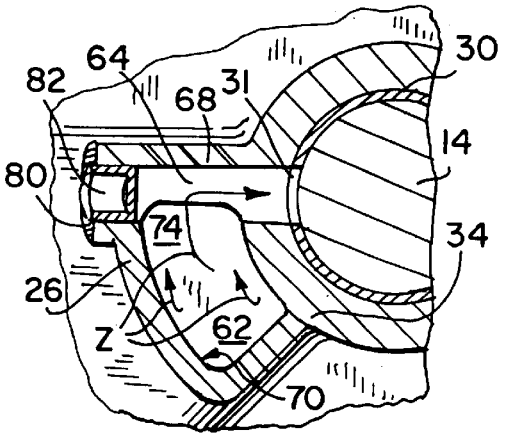
FIG. 5

FIG. 3
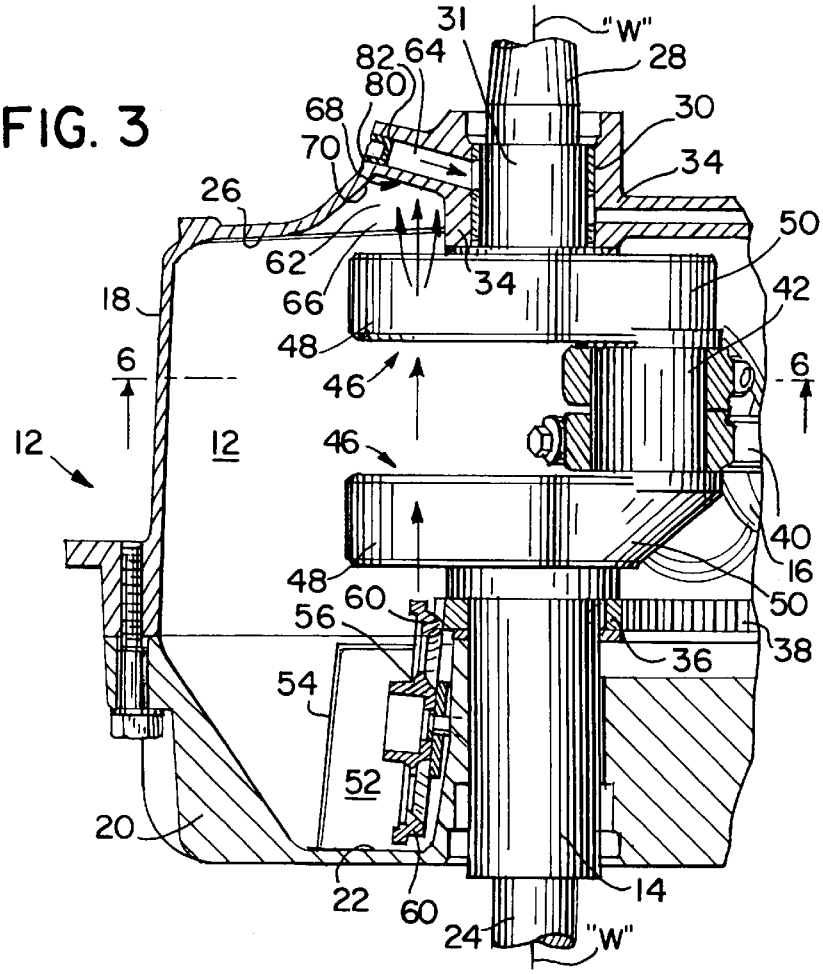
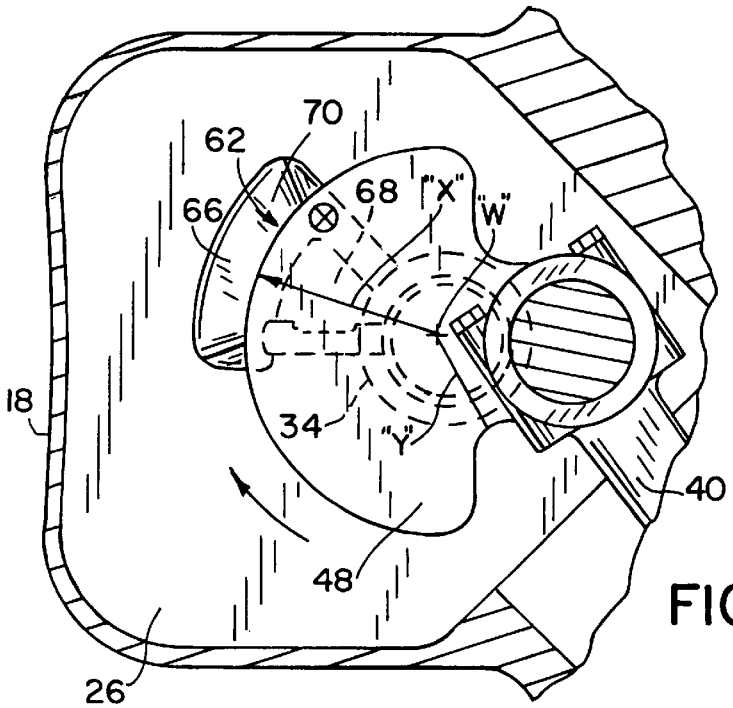
FIG. 6

FIG. 7
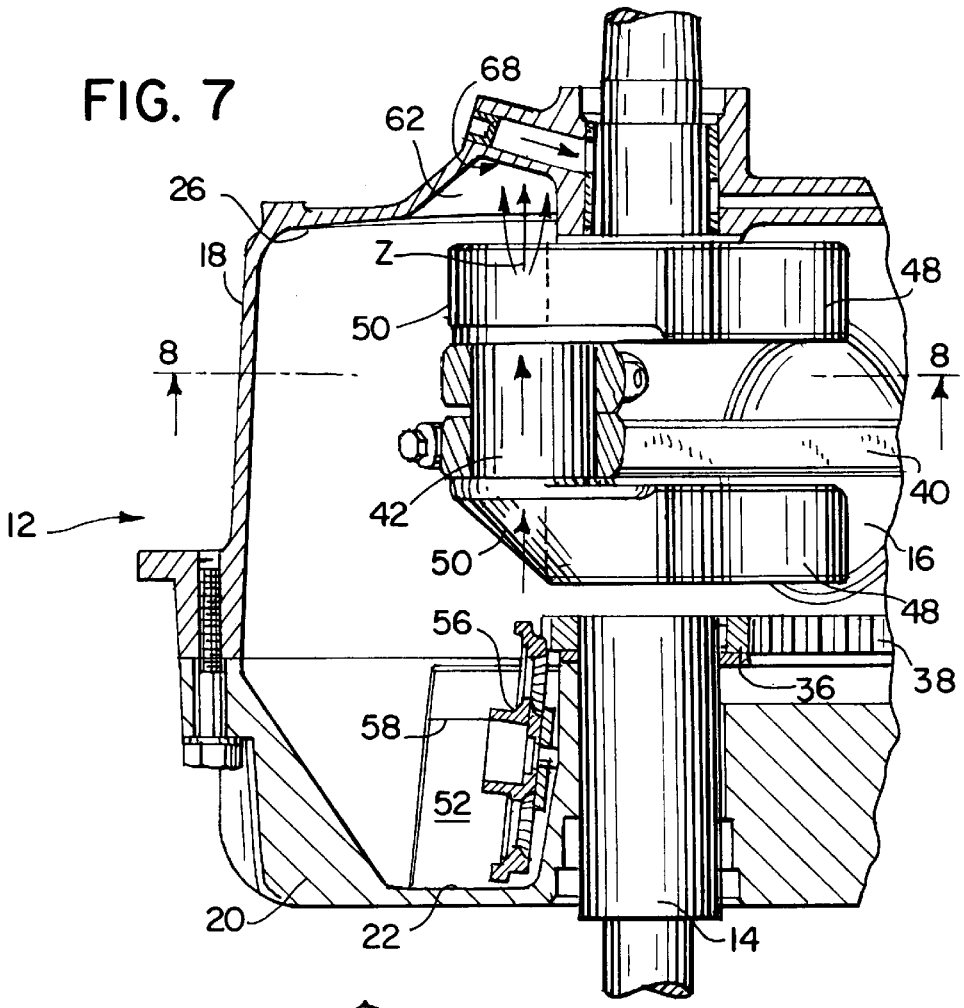
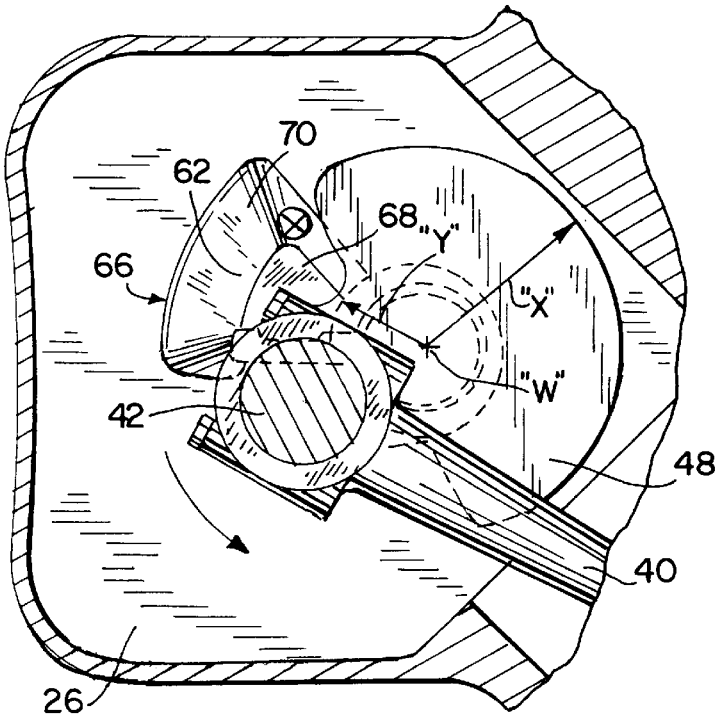
FIG. 8

LUBRICATION APPARATUS FOR SHAFT BEARING

TECHNICAL FIELD

The present invention relates generally to internal combustion engines, and more particularly to a lubrication system for an internal combustion engine.

BACKGROUND OF THE INVENTION

The importance of providing adequate lubrication to each of the movable components inside the crankcase of an internal combustion engine is well known. Without proper lubrication, the engine cannot operate efficiently and will eventually fail. For example, without proper lubrication, the bearings that support the crankshaft will quickly reach very high temperatures resulting in premature bearing failure or at least a substantial reduction in the operating life of the bearing. Accordingly, the lubrication system is a major concern in the design of the engine.

Some lubrication systems include a plurality of devices that mechanically move oil from oil reservoirs to movable components inside the engine housing. These lubrication devices may provide oil to the components mounted to, or connected with, the crankshaft and cam shaft, the cylinder bores and the pistons that move therein, as well as the bearings that support the crankshaft and/or cam shaft.

In the splash and spray lubrication system disclosed in U.S. Pat. No. 1,842,303, the connecting rods are provided with an extension or paddle on their crankshaft ends. Upon crankshaft rotation, the paddles dip into individual oil pits, thereby lubricating the connecting rod assembly, and then sling or spray the oil in the engine housing.

In the lubrication system disclosed in U.S. Pat. No. 1,271,140, a large spur gear is disposed in the bottom portion of the engine housing and is partially immersed in an oil reservoir. Further, the spur gear is disposed below a pinion mounted onto the crankshaft and meshes with the pinion upon rotation of the crankshaft. The pinion drives the spur gear and the spur gear rotates within the oil reservoir, thereby throwing oil outward to lubricate the crankshaft and the cam shaft.

Since the crankshaft bearings are typically located adjacent to the walls of the engine housing, it is often difficult for lubrication devices such as the devices described in the above patents (i.e., the paddle or the spur gear) to throw, spray, or otherwise provide an adequate amount of lubricant to the crankshaft bearings. Consequently, the lubrication systems for these engines must typically be equipped with additional devices for dispersing lubricant specifically in the direction of the crankshaft bearings.

In U.S. Pat. No. 1,842,303, the engine is provided with additional oil reservoirs that are located above each of the crankshaft bearings. Small ports on the bottom of each oil reservoir drip or feed oil onto the top of the bearing. In U.S. Pat. No. 1,271,140, the engine is provided with a second gear to supplement the spur gear that is partially immersed in the oil reservoir. The second gear is above the crankshaft and is rotated on a rotational plane that is turned about 90° from the spur gear. The second gear receives oil thrown by the spur gear and oil deflected by the other rotating components on the crankshaft. The second gear then flings the oil toward each of the crankshaft bearings.

SUMMARY OF THE INVENTION

The present invention relates to a lubrication system that provides lubricant to the components disposed inside an internal combustion engine, including to a bearing for a rotatable shaft. The present invention is particularly directed to a lubrication apparatus that receives and directs lubricant to a shaft bearing. In one embodiment, the lubrication apparatus is incorporated in a lubrication system for a V-twin engine having a vertical crankshaft. However, the invention described herein is also adaptable to other types of engines, including horizontal shaft-type engines.

A lubrication apparatus according to the invention is adaptable to an engine including a housing, a shaft disposed inside the housing and having a rotational axis, a shaft bearing supporting the shaft, and at least one lubricant dispersing device (e.g., a slinger gear) dispersing lubricant inside the housing. The lubrication apparatus includes a recess that is formed within the housing and that has a recess opening adapted to receive lubricant dispersed by the lubricant dispersing device. The lubrication apparatus also includes an elongated trough that is disposed substantially within the recess. The trough has an elongated opening, is in fluid communication with the shaft bearing, and is adapted to direct lubricant received in the recess to the shaft bearing.

Preferably, the recess opening extends substantially radially outward relative to the rotational axis of the shaft and extends far enough that, during at least one portion of the engine cycle, a substantially direct and substantially unobstructed lubricant dispersing path is defined between the lubricant dispersing device and the recess opening. The recess may be integrally formed with the housing and may include a back surface that is disposed such that the back surface and the recess opening define a substantially unobstructed space therebetween. Further, the recess may have a sidewall that is disposed substantially adjacent to the shaft bearing.

Preferably, the elongated opening of the trough extends substantially radially outward relative to the rotational axis of the shaft such that lubricant received in the recess is collected in the trough. Further, the trough may be inclined downwardly in a direction toward the shaft bearing, such that lubricant collected in the trough flows easily into the shaft bearing. Additionally, the trough may be formed, at least partially, in a boss that is formed integral with the housing.

In another aspect of the invention, the lubrication apparatus is incorporated in a lubrication system that includes a lubricant reservoir formed within the housing and a lubricant dispersing device that is disposed in communication with the lubricant reservoir. A recess opening receives lubricant dispersed by the lubricant dispersing device, and an elongated trough directs the lubricant to a shaft bearing.

In an alternative embodiment for a vertical crankshaft engine including a housing having a lower and an upper wall, a lubrication system includes a reservoir disposed substantially adjacent to the lower wall, a single lubricant dispersing device disposed in communication with the lubricant reservoir, and a lubrication apparatus. The lubrication apparatus receives lubricant dispersed by the lubricant dispersing device and directs the lubricant to a bearing mounted onto the crankshaft at an interface of the crankshaft and the upper wall. Further, the lubrication dispersing device may be driven by a driving gear mounted on the crankshaft between a connecting rod and the lower wall. Accordingly, the recess opening preferably extends radially outward such that the lubricant dispersing device is able to disperse lubricant along a substantially direct and substantially unobstructed path from the lubricant dispersing device into a recess opening of the lubrication apparatus.

It is a feature and an advantage of the present invention to provide a lubrication system for directing lubricant to a plurality of engine components, including a crankshaft bearing.

It is a feature and an advantage of the present invention to provide a lubrication system for directing lubricant to a plurality of engine components, including a crankshaft bearing, using a single lubricant dispersing device.

It is a feature and an advantage of the present invention to provide an apparatus that directs lubricant to a crankshaft bearing, wherein the lubricant dispersing device is located adjacent to a first wall of the crankcase and the crankshaft bearing is located adjacent to an opposite wall of the housing.

It is a feature and an advantage of the present invention to provide a lubrication system that directs lubricant to a crankshaft bearing of an internal combustion engine utilizing the reciprocating motion of the crankshaft and/or the components mounted thereon.

It is a feature and an advantage of the present invention to provide a lubrication system adaptable to a vertical shaft-type engine.

It is a feature and an advantage of the present invention to provide a lubrication system for directing lubricant to a plurality of engine components, including a crankshaft bearing, that utilizes a minimum number of components and is easy to assemble.

It is a feature and an advantage of the present invention to provide a low cost lubrication system that utilizes a single lubricant reservoir.

BRIEF DESCRIPTION OF THE DRAWINGS

FIG. 2 is a sectional view along line 2—2 of FIG. 1.

FIG. 3 is a sectional view along line 3—3 of FIG. 2.

FIG. 4 is a sectional view along line 4—4 of FIG. 2.

FIG. 5 is a sectional view along line 5—5 of FIG. 4.

FIG. 6 is a sectional view along line 6—6 of FIG. 3.

FIG. 7 is a vertical sectional view of the engine of FIG. 1.

FIG. 8 is a sectional view along line 8—8 of FIG. 7.

DETAILED DESCRIPTION

Figure 1:
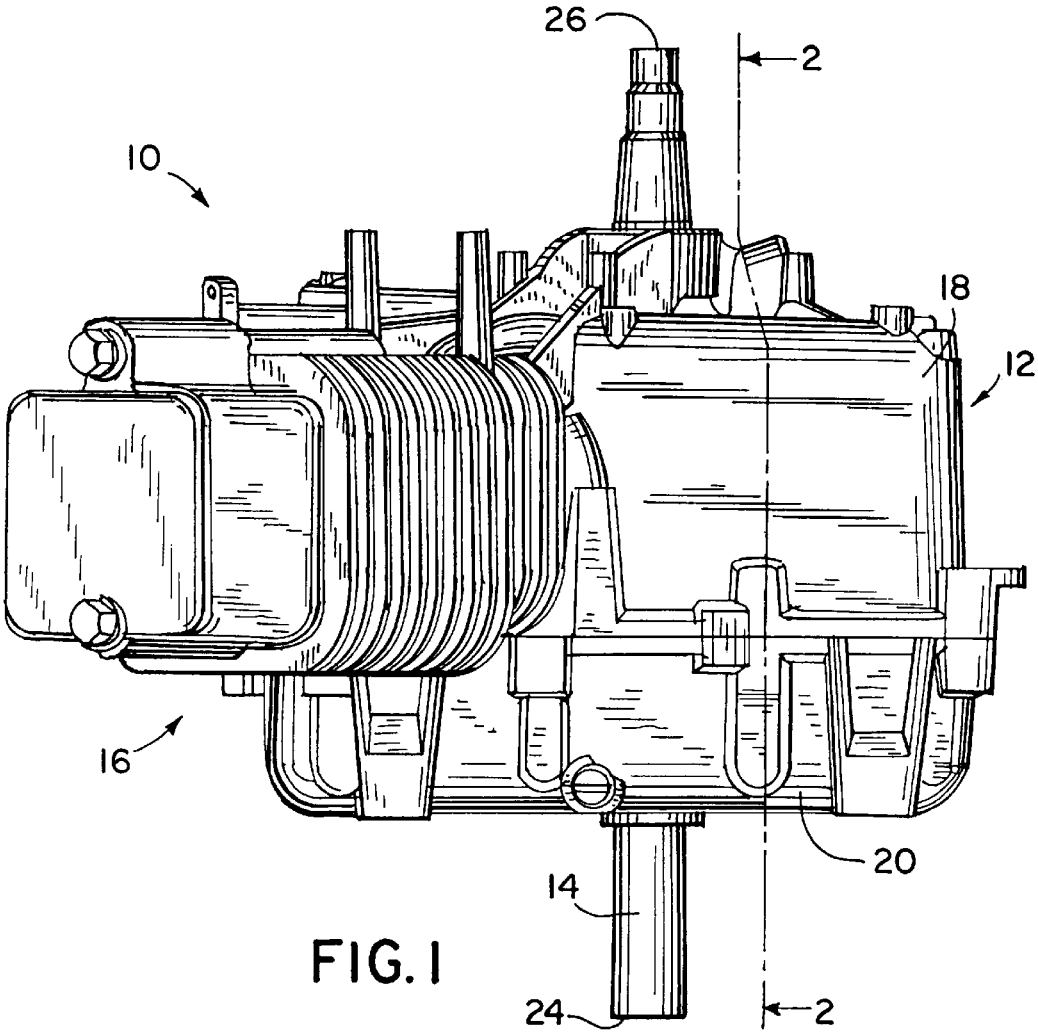
FIG. 1 is an elevation side view of a vertical crankshaft-type internal combustion engine incorporating the present invention.

FIGS. 1–8 depict a V-twin, vertical shaft-type internal combustion engine 10 incorporating the invention. Referring to FIG. 1, the engine 10 includes a crankcase 12, a crankshaft 14 extending through the crankcase 12, and a pair of cylinders 16. The cylinders 16 are disposed horizontally adjacent to the crankcase 12 and form a "V" configuration with the crankshaft 14. The engine 10 illustrated in the drawings and described herein incorporates a design that may be utilized in 18–22 hp engines.

It should be noted that although the present invention is particularly adaptable to vertical shaft-type engines such as the engine 10 depicted in the drawings, the lubrication system described herein and other aspects of the invention are also adaptable to engines of other types, sizes and configurations. For example, it will be apparent to one of ordinary skill in the art to adapt the present lubrication system to a horizontal shaft-type engine or an engine wherein the cylinders are not disposed in a "V" configuration.

Referring to FIGS. 1 and 2, the crankcase 12 comprises two cast portions—an upper portion 18 and a lower portion 20. The lower portion 20 includes a generally horizontally disposed lower wall 22 (FIG. 2). A power takeoff end 24 of the crankshaft 14 extends downwardly through the lower wall 22. The upper portion 18 includes an upper wall 26 that is disposed opposite of the lower wall 22. A magneto end 28 of the crankshaft 14 extends upwardly through the upper wall 26.

Referring to FIG. 3, the crankshaft 14 is rotatable about an axis "W". To rotatably support the upper portion of the crankshaft 14, a crankshaft bearing 30 is mounted onto the crankshaft 14 at the junction of the crankshaft 14 and the upper wall 26. The upper wall 26 forms a bushing or bearing cover 34 that surrounds the upper crankshaft bearing 30 and helps secure the upper crankshaft bearing 30 between the outer surface of the crankshaft 14 and the bearing cover 34 (see also FIG. 2). Further, the upper crankshaft bearing 30 is provided with an inlet port 31 to allow lubricant to be fed into the bearing 30.

FIGS. 2 and 3 depict several engine components that are mounted to, or otherwise interconnected with, the crankshaft 14. Near the lower portion 20 of the crankcase 12, a timing gear 36 is rotatably mounted onto the crankshaft 14. The timing gear 36 is disposed so as to intermesh with a cam gear 38 and to rotatably drive the cam gear 38 upon crankshaft rotation. Above the timing gear 36, a pair of connecting rods 40 are connected to a crankpin 42 of the crankshaft 14. Each connecting rod 40 extends radially outward from the crankpin 42 to one of the cylinders 16, where the connecting rod 40 is connected to a movable piston (not shown).

On each side of the pair of connecting rods 40, the crankshaft 14 is provided with an eccentric assembly 46 comprising a counterweight 48 and a crank throw 50 (see FIG. 3). Referring to the axial end views of FIGS. 6 and 8, each counterweight 48 includes a relatively thick radial section "X" and a relatively thin radial section "Y" (the sections X,Y being defined by the radial distance between the rotational axis "W" of the crankshaft 14 and the radial perimeter of the counterweight 48). FIGS. 6 and 8 also depict the radial positions of the counterweights 48, crank throws 50, and connecting rods 40 at two distinct points in the engine cycle. During some portions of the engine cycle, the counterweight-crank throw assembly 46, particularly the relatively thick sections "X" of the counterweights 48, tend to obstruct the dispersal of lubricant upwardly into the upper portion 18 of crankcase 12. However, it will be shown below that the reciprocating motion of the counterweight-crank throw assemblies 46 actually facilitates the operation of the lubrication system of the present invention during other portions of the engine cycle.

A lubrication system according to the present invention includes a lubricant dispersing device (e.g., a slinger gear 56) that is disposed in communication with a lubricant source (e.g., an oil reservoir 52) and adapted to dynamically disperse oil outwardly in an engine housing (e.g., crankcase 12). The lubrication dispersing device may employ any of several known methods of communicating with the lubricant source, including having a portion of the lubricant dispersing device physically splash or dip into the oil reservoir 52, or receiving oil from an oil pump or oil conduit. Further, the lubricant dispersing device may employ a paddle, a dipper extension, or gears to sling, throw, or otherwise disperse the oil outwardly in the crankcase. One aspect of the present lubrication system is that it can utilize a single lubricant dispersing device to provide lubrication to the components disposed within or adjacent a crankcase, including the crankshaft bearings.

Referring now to the vertical shaft-type engine 10 depicted in the drawings, the lubrication system preferably includes an oil reservoir 52 formed within the lower portion 20 of the crankcase 12 (see FIGS. 2 and 3). The oil reservoir 52 is disposed adjacent to the lower wall 22 and on a side of the crankshaft 14 away from the cam gear 38 and away from the cylinders 16. The oil reservoir 52 includes a shroud 54 that extends upwardly into the crankcase 12. The cross-section of the shroud 54 is preferably semi-circular so that it can accommodate a generally circular lubrication dispersing device such as a rotatable slinger gear 56 (see FIG. 2). The oil reservoir 52 is typically maintained at an oil level 58 wherein about two-thirds of the slinger gear 56 is immersed in oil.

The specific design of the slinger gear 56 is conventional. Referring to FIG. 3, the slinger gear 56 includes beveled gear teeth 60 which are adapted to intermesh with the teeth of timing gear 36 at a pre-determined angle. Whereas the timing gear 36 rotates about a generally horizontal plane that is normal to the rotational axis "W", the slinger gear 56 is rotatably driven on a plane that is generally transverse to the horizontal plane. Preferably, the slinger gear 56 is mounted at an angle of about 30° or less from a vertical plane.

In alternative embodiments, the slinger gear may be replaced with an alternate lubrication dispersing device, such as a spur gear, or may be driven by a driving gear other than the timing gear. Further, the slinger gear may be rotatably driven at a different angle or may be disposed co-planar with the driving gear. In alternative embodiments including a horizontally disposed crankshaft or cam shaft, an oil reservoir and an oil dispersing device may be mounted below the shaft and driven by a driving gear mounted on the shaft. In such an embodiment, it may be preferable to transversely mount the oil dispersing device such that it is turned about 90° from the driving gear.

Referring to FIG. 3, oil dispersed by the slinger gear 56 generally travels upwardly from the slinger gear 56 and across the crankshaft 14. Some oil might land directly on the connecting rods 40 or on the counterweight-crank throw assembly 46, and provide lubrication to these components. Some oil is deflected by the rotation of the crankshaft 14 and is dispersed to lubricate other parts of the engine 10.

In the present lubrication system, the slinger gear 56 also provides oil to the upper crankshaft bearing 30. Referring to FIGS. 2 through 6, the upper wall 26 includes an irregular formation or recess 62 preferably located near the crankshaft 14. An elongated trough 64 extends substantially across the inside of the recess 62 and terminates into the oil port 31 of the upper crankshaft bearing 30. Together, the recess 62 and the elongated trough 64 provide a lubrication structure particularly adapted to receive lubricant dispersed by the slinger gear 56 and to direct the lubricant into the upper crankshaft bearing 30.

Referring to FIGS. 2 and 3, the recess 62 is integrally cast within the upper wall 26 of the upper portion 18 and is substantially adjacent to the bearing cover 34. The recess 62 includes a recess opening 66, a back surface 68 disposed opposite the recess opening 66, and sidewalls 70 that extend between the recess opening 66 and the back surface 68. Referring to FIG. 6, the recess opening 66 extends radially outward from the bearing cover 34 to the generally horizontal surface of the upper wall 26. Referring to FIGS. 2 and 3, the recess opening 66 is aligned vertically with the slinger gear 56 and the oil reservoir 52; therefore, the recess opening 66 is advantageously positioned to receive lubricant dispersed by the slinger gear 56.

Referring to FIG. 6, the sidewalls 70 generally taper radially inward and upwardly from the recess opening 66 to the back surface 68. Opposite the sidewalls 70, the outer portion of the bearing cover 34 forms the remaining boundary of the recess 62. The recess 62 therefore defines an irregularly shaped but substantially unobstructed space that extends from a relatively large recess opening 66 to a reduced back surface 68 that is substantially adjacent to the bearing cover 34.

Referring now to FIGS. 2 through 5, the trough 64 is preferably disposed substantially adjacent to a junction of the sidewalls 70 and the back surface 68, and extends radially outward relative to the rotational axis "W" of the crankshaft 14 (FIG. 3). The trough 64 is formed within a boss 72 on the upper wall 26 (see e.g., FIG. 2). The boss 72 is formed integral with the casting of the upper portion 18 and then drilled from the outside of the crankcase 12 to the oil port 31. An outer end 80 of the trough 64 is subsequently sealed with a plug 82. The drilling operation breaks out a side of the boss 72 which creates an elongated opening 74 that faces the sidewalls 70 but away from the recess opening 66 (see e.g., FIGS. 2 and 4). The drilling operation also forms an elongated rib 76 that provides the bottom of the trough 64.

To facilitate oil flow into the oil port 31 (FIG. 5), the trough 64 is inclined downwardly from the relatively high outer end 80 to the relatively low oil port 31. Referring to the elevation view of FIG. 4, a center axis "V" of the trough 64 and the magneto end of the rotational axis "W" of the crankshaft 14 define an angle θ therebetween. The angle θ is typically between 45° and 90°, but preferably about 65° for the vertical shaft-type engine 10 depicted in the drawings.

It should be noted that the recess 62 and the elongated trough 64 may be easily adapted to a horizontal shaft-type engine. For example, assuming the engine 10 depicted in FIG. 2 is modified for a horizontal shaft design, a slinger gear and an oil reservoir would preferably be mounted below the timing gear 36 and disposed so as to disperse lubricant lengthwise across the crankcase 12. In this engine, the recess and elongated trough may have substantially the same structure and substantially the same disposition relative to the crankshaft 14 as the recess 62 and elongated trough 64 depicted in FIG. 2.

FIG. 8 illustrates the relative orientations of the connecting rods 40 and the counterweight-crankthrow assemblies 46 at one point in the engine cycle as viewed from the oil reservoir 52. At this point and through other stages in the engine cycle, only the radial section "Y" of the counterweight 48, and portions of the crankpin 42 and connecting rod 40, obstruct the recess opening 66 from the slinger gear 56. Accordingly, it is preferable to construct the recess opening 66 such that it extends radially outward, relative to the rotational axis "W", at least farther than the radial section "Y" of the counterweight 48. In this way, there is a direct and unobstructed path between the recess opening 66 and the slinger gear 56 during at least a portion of the engine cycle, and the recess 62 receives "direct shots" of lubricant from the slinger gear 56.

For the 18–22 hp engine 10 depicted in the drawings, the radial width of recess opening 66 is preferably between about 1" and about 1⅝". At a radial width of about 1", the recess opening 66 extends radially outward just past the relatively thin sections "Y" of the counterweights 48. At a radial width of about 1⅝", the recess opening 66 extends radially outward past the relatively thick sections "X" of the counterweights 48, and can receive direct shots of lubricant from the slinger gear 56 throughout the engine cycle. Note, however, that the recess opening could have a larger radial width, if desired.

The radial width of the recess opening 66 depicted in the drawings is approximately 1½". FIG. 6 depicts the relative orientations of the connecting rods 40 and the counterweight-crank throw assemblies 46 at another point in the engine cycle, as viewed from the oil reservoir 52 (see also FIG. 3). Even when the counterweight 48 is at this orientation, the recess opening 66 extends radially outward beyond the radial perimeter of the counterweights 48 (i.e., beyond the greater radial dimension "X" in FIG. 6). Thus, the recess opening 66 may receive a direct shot of lubricant from the slinger gear 56.

Nevertheless, the operation of the present lubrication system does not rely entirely on the slinger gear 56 to disperse direct shots of oil through the recess opening 66. During engine operation, the reciprocating motion of the crankshaft 14, particularly the motion of the connecting rods 40 and the counterweight-crank throw assemblies 46, causes air in the crankcase 12 to swirl or rotate as the spaces around the crankshaft 14 is continually displaced of air. The air swirl tends to break up sheets of oil that are normally thrown upwardly by the slinger gear 56 and the crankshaft 14, and transforms the oil sheets into a swirling mist or spray. Near the upper wall 26, the oil mist is directed substantially radially inward with respect to the crankshaft rotational axis "W." Therefore, the recess opening 66 is optimally positioned to receive the swirl of oil mist and spray.

Referring to FIG. 2, the swirling oil mist (represented by arrows "Z") that enters the recess 62 continue to move radially inwardly and in the direction of the elongated trough 64. Thus, the placement of the trough 64 along the junction of the sidewalls 70 and the back surface 68 is particularly adapted to collecting the oil mist that is received in the recess 62. Moreover, because the oil mist is directed somewhat radially inward, the tapered sidewalls 70 do not substantially obstruct the path of the oil mist, although some oil may be first deflected by the sidewalls 70 or the back surface 68 before collecting in the trough 64. Then, the incline of the trough 64 directs the collected oil downwardly through the bearing cover 34 and into the oil port 31 of upper crankshaft bearing 30.

It should be noted that the aspect of the invention directed to the receiving structure, including the structure and function of the recess 62 and of the elongated trough 64, may be adapted to other lubrication systems. Furthermore, the recess and elongated trough may be adapted to systems for providing lubricant to bearings mounted onto shafts other than crankshafts, e.g., a cam shaft.

While a preferred embodiment of the present invention has been shown and described, alternate embodiments will be apparent to those skilled in the art and are within the intended scope of the present invention. Therefore, the scope of the present invention is to be limited only by the following claims.

What is claimed is:

1. A lubrication apparatus for an internal combustion engine that receives lubricant and directs the lubricant to a shaft bearing, the engine including a housing, a shaft disposed inside the housing and having a rotational axis, a shaft bearing supporting the shaft, and a slinger dispersing lubricant inside the housing, the apparatus comprising:

a recess formed within the housing, said recess having a recess opening adapted to receive lubricant dispersed by said slinger, said recess opening extending substantially radially outward relative to the rotational axis of the shaft such that, during at least a portion of the engine cycle, a substantially direct and substantially unobstructed lubricant dispersing path is defined between said slinger and said recess opening; and an elongated trough disposed substantially within said recess and in fluid communication with the shaft bearing, said trough being adapted to direct lubricant received in said recess to the shaft bearing.

2. The lubrication apparatus of claim 1, wherein said trough is inclined in a direction toward the shaft bearing.

3. The lubrication apparatus of claim 1, wherein said recess is integrally formed with the housing.

4. The lubrication apparatus of claim 1, further comprising:

a boss integrally formed with the housing, said trough being formed, at least partially, in said boss.

5. The lubrication apparatus of claim 1, wherein said recess opening extends substantially radially outward relative to the rotational axis of the shaft.

6. The lubrication apparatus of claim 1, wherein said trough includes an elongated opening that extends substantially radially outward relative to the rotational axis of the shaft.

7. The lubrication apparatus of claim 1, wherein said recess further includes:

a back surface disposed such that said back surface and said recess opening define a substantially unobstructed space therebetween.

8. The lubrication apparatus of claim 7, wherein said recess includes a sidewall disposed substantially adjacent to the shaft bearing.

9. A lubrication system for an internal combustion engine, the engine including a housing, a shaft disposed inside the housing and having a rotational axis, and a shaft bearing supporting the shaft, said lubrication system comprising:

a lubricant reservoir formed within the housing;

a slinger disposed in communication with said lubricant reservoir, said slinger dispersing lubricant inside the housing;

a recess formed within the housing, said recess having a recess opening aligned with said slinger to receive lubricant dispersed by said slinger, said recess opening extending substantially radially outward relative to the rotational axis of the shaft such that, during at least a portion of the engine cycle, a substantially direct and substantially unobstructed lubricant dispersing path is defined between said slinger and said recess opening; and an elongated trough disposed substantially within said recess and in fluid communication with the shaft bearing, said trough being adapted to direct lubricant received in said recess to the shaft bearing.

10. The lubrication system of claim 9, wherein said trough is inclined in a direction toward the shaft bearing.

11. The lubrication system of claim 9, wherein said recess is integrally formed with the housing.

12. The lubrication system of claim 9, further comprising:

a boss integrally formed with the housing, said trough being at least partially formed in said boss.

13. The lubrication apparatus of claim 9, wherein said recess opening extends substantially radially outward relative to the rotational axis of the shaft.

14. The lubrication system of claim 9, wherein said trough includes an elongated opening that extends radially outward relative to the rotational axis of the shaft.

15. The lubrication apparatus of claim 9, wherein said recess further includes:

a back surface disposed such that said back surface and said recess opening define a substantially unobstructed space therebetween.

16. The lubrication apparatus of claim 15, wherein said recess includes a sidewall that is disposed substantially adjacent to the shaft bearing.

17. The lubrication system of claim 9, wherein a connecting rod is interconnected with the shaft, said lubrication system further comprising:

a driving gear mounted on the shaft, wherein the connecting rod is disposed between the driving gear and the shaft bearing, said driving gear adapted to rotatably drive said lubricant dispersing device.

18. The lubrication system of claim 9, wherein the shaft extends between a first wall and a second wall, the shaft bearing being disposed substantially adjacent to the first wall and said lubricant reservoir being disposed substantially adjacent to the second wall.

19. A lubrication system for an internal combustion engine, the engine including a housing having a lower wall and an upper wall, a generally vertically disposed shaft having a rotational axis and extending between the lower and upper walls, and a shaft bearing supporting the shaft, the shaft bearing being disposed substantially adjacent to the upper wall, said lubrication system comprising:

a lubricant reservoir formed within the housing and disposed substantially adjacent to the lower wall;

a slinger disposed in communication with said lubricant reservoir, said slinger dispersing lubricant inside the housing to provide lubrication to a plurality of engine components; and a lubrication apparatus that receives lubricant dispersed by said slinger and that directs the lubricant to the shaft bearing, said lubrication apparatus being disposed in fluid communication with the shaft bearing and including a recess at least partially formed adjacent to the upper wall, said recess having a recess opening that is adapted to receive lubricant dispersed by said slinger, and said recess opening extending substantially radially outward relative to the rotational axis of the shaft such that, during at least a portion of the engine cycle, a substantially direct and substantially unobstructed lubricant dispersing path is defined between said slinger and said recess opening.

20. The lubrication system of claim 19, wherein said recess is integrally formed with the upper wall of the housing.

21. The lubrication system of claim 19, wherein said lubrication apparatus further includes:

an elongated trough disposed substantially within said recess and in fluid communication with the shaft bearing, said trough being adapted to direct lubricant received in said recess to the shaft bearing.

22. The lubrication system of claim 21, wherein said trough is inclined in a direction toward the shaft bearing.

23. The lubrication system of claim 21, further comprising:

a boss integrally formed with the upper wall of the housing, said trough being at least partially formed in said boss.

24. The lubrication system of claim 21, wherein said elongated trough includes an elongated opening that extends radially outward relative to the rotational axis of the shaft.

25. The lubrication system of claim 19, wherein said recess opening extends substantially radially outward relative to the rotational axis of the shaft.

26. The lubrication system of claim 19, wherein said recess further includes:

a back surface disposed such that said back surface and said recess opening define a substantially unobstructed space therebetween.

27. The lubrication apparatus of claim 26, wherein said recess includes a sidewall that is disposed substantially adjacent to the shaft bearing.

28. The lubrication system of claim 19, wherein a connecting rod is interconnected with the shaft, the lubrication system further comprising:

a driving gear mounted on the shaft between the connecting rod and the lower wall, said driving gear being adapted to rotatably drive said lubricant dispersing device.

29. The lubrication system of claim 19, wherein the engine is a V-twin engine.

* * * * *